United States Patent [19]

Diekevers et al.

[11] Patent Number: 5,009,017

[45] **Date of Patent: * Apr. 23, 1991**

[54] RETAINING PIN HAVING A POSITIVE KEEPER MEANS

[75] Inventors: Mark S. Diekevers; Jerry D. Fidler, both of East Peoria, Ill.

[73] Assignee: Caterpillar Inc., Peoria, Ill.

[ * ] Notice: The portion of the term of this patent subsequent to Apr. 25, 2006 has been disclaimed.

[21] Appl. No.: 281,361

[22] Filed: Dec. 8, 1988

Related U.S. Application Data

[60] Division of Ser. No. 105,469, Sep. 30, 1987, Pat. No. 4,823,486, which is a continuation of Ser. No. 4,515, Jan. 20, 1987, abandoned.

[51] Int. Cl.[5] ..... E02F 9/28

[52] U.S. Cl. ..... 37/142 A; 411/353

[58] Field of Search ..... 37/142 R, 141 T, 142 A; 299/91; 403/155, 326; 411/352, 353, 517, 518

[56] References Cited

U.S. PATENT DOCUMENTS

| | | | |
|---|---|---|---|
| 3,466,073 | 9/1969 | Pohle | 403/326 |
| 3,535,977 | 10/1970 | Baumgarten | 403/326 |
| 3,952,433 | 4/1976 | Heinold et al. | 37/142 A |
| 3,959,901 | 6/1976 | Klett | 37/142 R |
| 3,990,162 | 11/1976 | Heinold et al. | 37/142 A |
| 3,997,989 | 12/1976 | Stepe | 37/142 A |
| 4,096,653 | 6/1978 | Kaarlela et al. | 37/142 A |
| 4,324,517 | 4/1982 | Dey | 411/353 |
| 4,405,251 | 9/1983 | Kolchinsky et al. | 403/9 |
| 4,447,750 | 5/1984 | Howlett et al. | 403/326 |
| 4,594,040 | 6/1986 | Molina | 411/517 |
| 4,692,079 | 9/1987 | Killian et al. | 411/353 |
| 4,762,024 | 8/1988 | Graft | 74/715 |
| 4,815,908 | 3/1989 | Duran et al. | 411/353 |
| 4,823,486 | 4/1989 | Diekevers et al. | 37/142 R |

FOREIGN PATENT DOCUMENTS

| | | | |
|---|---|---|---|
| 2620142 | 11/1977 | Fed. Rep. of Germany | 403/326 |
| 2390618 | 12/1978 | France . | |
| 1518824 | 7/1978 | United Kingdom | 37/142 R |
| 2178496 | 2/1987 | United Kingdom . | |

*Primary Examiner*—Clifford D. Crowder
*Assistant Examiner*—Huong Q. Pham
*Attorney, Agent, or Firm*—Kenneth A. Rhoads

[57] ABSTRACT

A retaining pin, a metallic washer and a resilient retaining ring for use in securing an earthworking tip to an adapter. Positive retention of earthworking tips on their adapters by their retaining pins during its work cycle is extremely important from an operational, as well as a cost, standpoint. The loss of the tips materially affects production in addition to the time-consuming expense of replacement or repair of the components. Not only must the tips be adequately retained, they must be capable of quick removal for replacement purposes. The retaining pin has an outer peripheral surface and an annular groove defined in the peripheral surface. The washer is slidably disposed on the pin. The washer has a frusto-conical side surface and an inner peripheral surface with an annular groove defined in the peripheral surface. The ring has a cross-section with a predetermined radial thickness and when assembled is disposed in locking engagement in a groove on the pin and the groove of the washer. The retaining ring, in use, is operative in conjunction with the grooves in the pin and washer to prohibit disassembly of the pin from the washer without an external force being applied to the pin sufficient to shear the retaining ring or to fracture the washer.

14 Claims, 3 Drawing Sheets

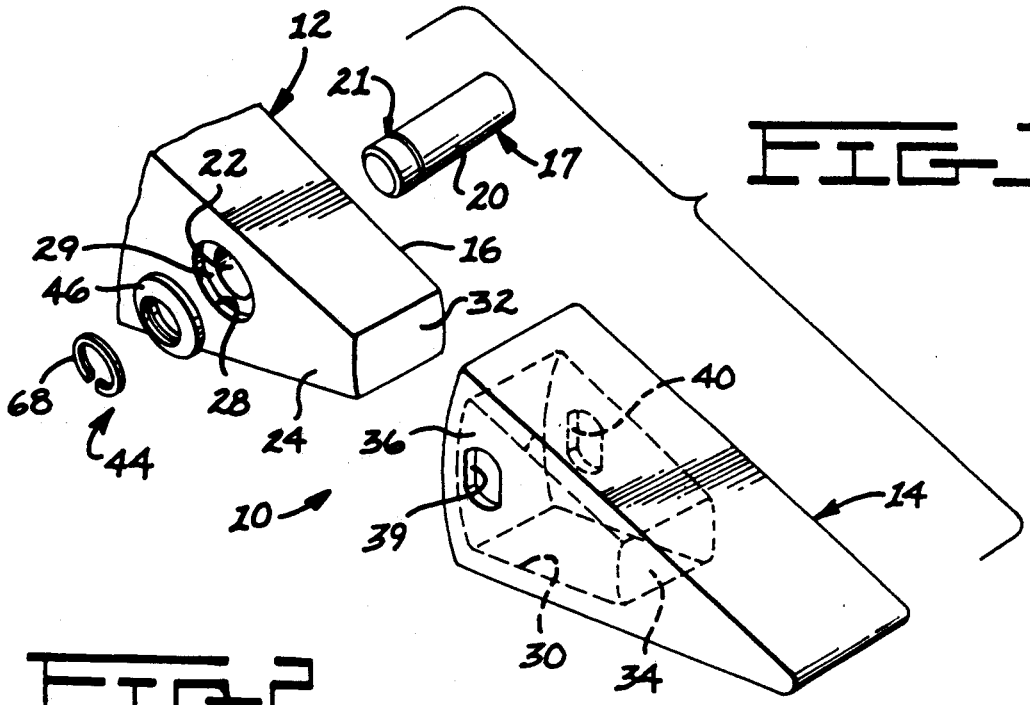
FIG-1
FIG-2
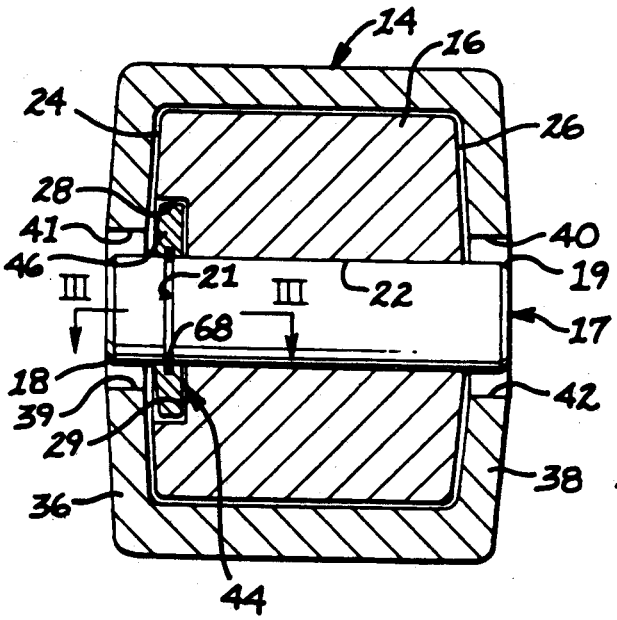
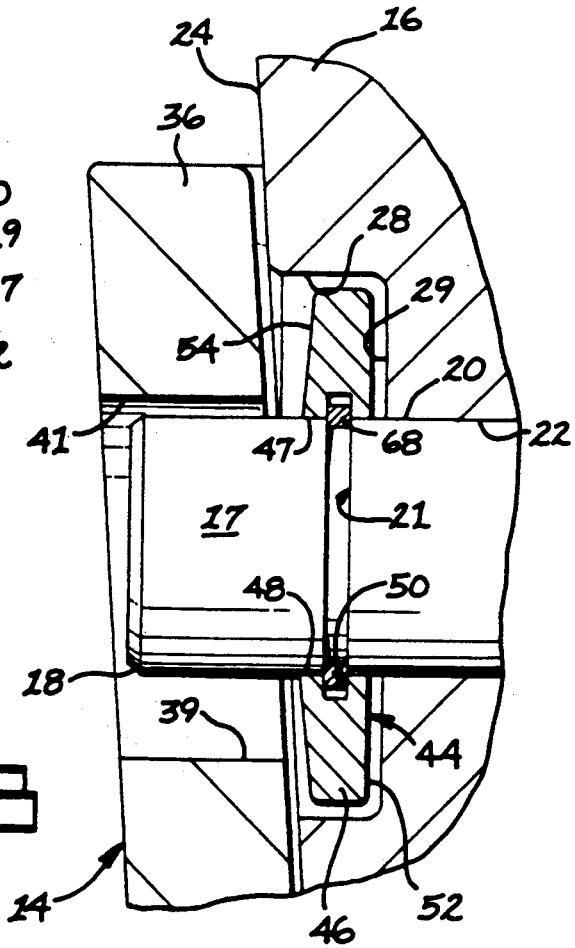
FIG-3

RETAINING PIN HAVING A POSITIVE KEEPER MEANS

CROSS-REFERENCE

This application is a division of application Ser. No. 07/105,469 filed Sept. 30, 1987, now U.S. Pat. No. 4,823,486 which is a continuation of application Ser. No. 07/004,515 filed Jan. 20, 1987, now abandoned.

TECHNICAL FIELD

This invention relates to retaining pins and more particularly to a retaining pin having a positive keeper means for use in securing an earthworking tip to an adapter.

BACKGROUND ART

Replaceable earthworking tips or teeth commonly used on rippers, loader buckets and trenchers must be positively secured in place on their support adapters and yet be capable of quick removal for replacement purposes. In addition to the monetary value of the tip that is lost, the loss of the tip will subject the adapter to damage requiring time consuming expensive repairs and/or replacement. Loss of the tip, when used in conjunction with rock crushing equipment, causes severe damage to the equipment should it become digested or jammed therein.

Prior art retaining pins for securing an earthworking tip on its adapter have not been totally successful especially when used in combination with impact rippers. In such application, the retaining pins are subjected to extreme vibration resulting in breakage of the pins or the retaining mechanism becoming loose causing loss of the pin and the tip.

Typically, retaining devices have been employed which relies on friction between mating surfaces for retention, U.S. Pat. No. 3,624,827 issued to Richard K. Liess et al. on Nov. 30, 1971, discloses a retaining pin having a friction ring disposed in a deep, wide, central groove of the pin. The pin is retained in a bore defined by the adapter nose solely by friction between the ring and the bore. Although this type of pin has been successful in normal ripper and bucket tip retaining applications, the central groove materially reduces the strength of the pin and subjects it to early failure in extremely severe applications. In addition, the pin can vibrate out of the bore since it is not positively retained.

U.S. Pat. No. 3,959,901 issued to Gene R. Klett on June 1, 1976, discloses another friction type retaining device in which the pin is retained solely by frictional engagement of the retaining pin with a lock ring. As before, vibration allows the pin to work its way loose resulting in loss of the pin and the separation of the tip from the adapter.

U.S. Pat. No. 3,952,433 issued to Lloyd K. Heinold et al. on Apr. 27, 1976, and U.S. Pat. No. 3,990,162 issued to Lloyd K. Heinold et al. on Nov. 9, 1976, disclose spring clips that straddle diametrially opposite sides of the retaining pin in expanded friction engagement. The clips are substantially encapsulated by an elastomeric material which aids in maintaining the spring clips in frictional engagement with the pins. Undesirably, the spring clips only partially engage the pins and the pins are easily removed by the spreading of the spring clips.

Accordingly, an improved earthworking device is provided so constructed that the earthworking tip is retained on the nose of the adapter by a pin that is positively retained in aligned apertures in the earthworking tip and the bore of the adapter. Preferably, the retaining pin is positively secured by a keeper means that is simple and economical in construction while maintaining the pin against outward axial movement during operation of the earthworking device.

The present invention is directed to overcoming one or more of the problems as set forth above.

DISCLOSURE OF THE INVENTION

In one aspect of the present invention, a retaining pin and a keeper means is provided for use in an earthworking device. The retaining pin includes an outer peripheral surface with an annular groove defined therein. The keeper means includes a metallic washer and a resilient retaining ring. The metallic washer includes a frusto-conical side surface and an inner peripheral surface with an annular groove defined in the peripheral surface. The metallic washer is slideably disposed on the pin and the resilient retaining ring, when assembled, is disposed in locking engagement within the groove on the pin and the groove in the washer. The retaining ring, in use, is operative to prohibit disassembly of the pin from the washer without an external force being applied to the pin sufficient to shear the retaining ring or to fracture the washer.

In another aspect of the present invention, a retaining pin and a keeper means is adapted for use in an earthworking device having a nose defining a bore and and an earthworking tip telescopically mounted on the nose. The tip defines a socket with a pair of spaced apart sidewalls and a pair of axially aligned holes in the sidewall. The bore in the nose of the adapter and the holes in the sidewalls of the tip are substantially axially aligned. A recess is defined in one of the nose or the tip and is in axial alignment with the bore and the holes. A retaining pin includes an outer peripheral surface and an annular groove defined in the outer peripheral surface. The keeper means includes a metallic washer and a resilient retaining ring. The metallic washer has a frusto-conical side surface and an inner peripheral surface and an annular groove defined in the surface. The keeper means when assembled is disposed in the recess and the pin, in use, is disposed in the aligned bore and the holes to retain the tip on the nose. The resilient retaining ring is disposed in locking engagement within the groove on the pin and the groove in the washer. The retaining ring, in use, is operative in conjunction with the grooves in the pin and the washer to prohibit disassembly of the pin from the washer without an external force being applied to the pin sufficient to shear the ring or to fracture the washer. One of the sides of the washer is adapted for cooperation with one of the lateral sidewalls of the nose and the tip to effectively concentrates the external force close to the interface of the grooves.

BRIEF DESCRIPTION OF THE DRAWINGS

FIG. 1 is an exploded isometric view of an earthworking device comprising an earthworking tip retained on the nose of an adapter by a retaining pin and a keeper means of the present invention;

FIG. 2 is an enlarged cross-sectional view of an assembled earthworking device;

FIG. 3 is an enlarged partial sectional view taken in the direction of arrows III—III in FIG. 2;

BEST MODE FOR CARRYING OUT THE INVENTION

Figure 4:
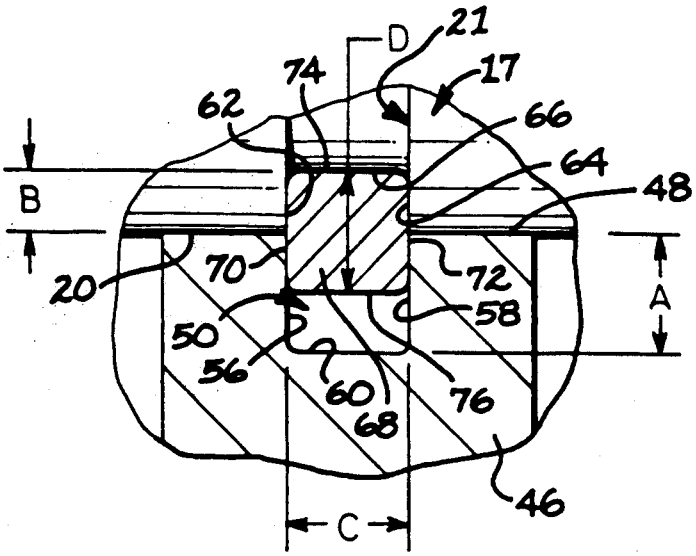
FIG. 4 is an enlarged cross-sectional view of the resilient retaining ring located in the groove of the pin and the groove of the washer.

Referring to FIGS. 1, 2, 3, and 4 an earthworking device 10 comprising a support member or adapter 12 having a tip 14 detachably mounted on a forward end or nose 16 thereof by a cylindrical retaining pin 17. The pin 17 has an outer peripheral surface 20 and an annular groove 21 defined therein. A pair of beveled surfaces 18 and 19 are provided at the intersection of the outer peripheral surface 20 with the ends of the pin 17. The nose 16, preferably of wedge shape, defines a transverse bore 22 and a pair of forwardly converging lateral sidewalls 24 and 26. It is noted that in some adapters 12, the sidewalls 24 and 26 may not be forwardly converging but be substantially parallel. A recess 28 having an end wall 29 is formed in the lateral sidewall 24 of the nose 16 and in concentric relationship with the bore 22.

A wedge-shaped socket 30 is formed in the tip 14 to accommodate the like-shaped nose 16 of the adapter 12. The nose preferably terminates at its apex defined by a surface 32 adapted to at least partially abut a surface 34 formed at the apex of recess 30 in the tip 14.

The tip 14 has a pair of forwardly converging spaced sidewalls 36 and 38 and a pair of laterally aligned holes 39 and 40 defined by peripheral surfaces 41 and 42. The sidewalls 36 and 38 are normally designed to conform generally to the sidewalls 24 and 26 of the nose 16. The holes 39 and 40 straddle bore 22 in the nose 16 and are in substantially axial alignment therewith.

Figure 7:
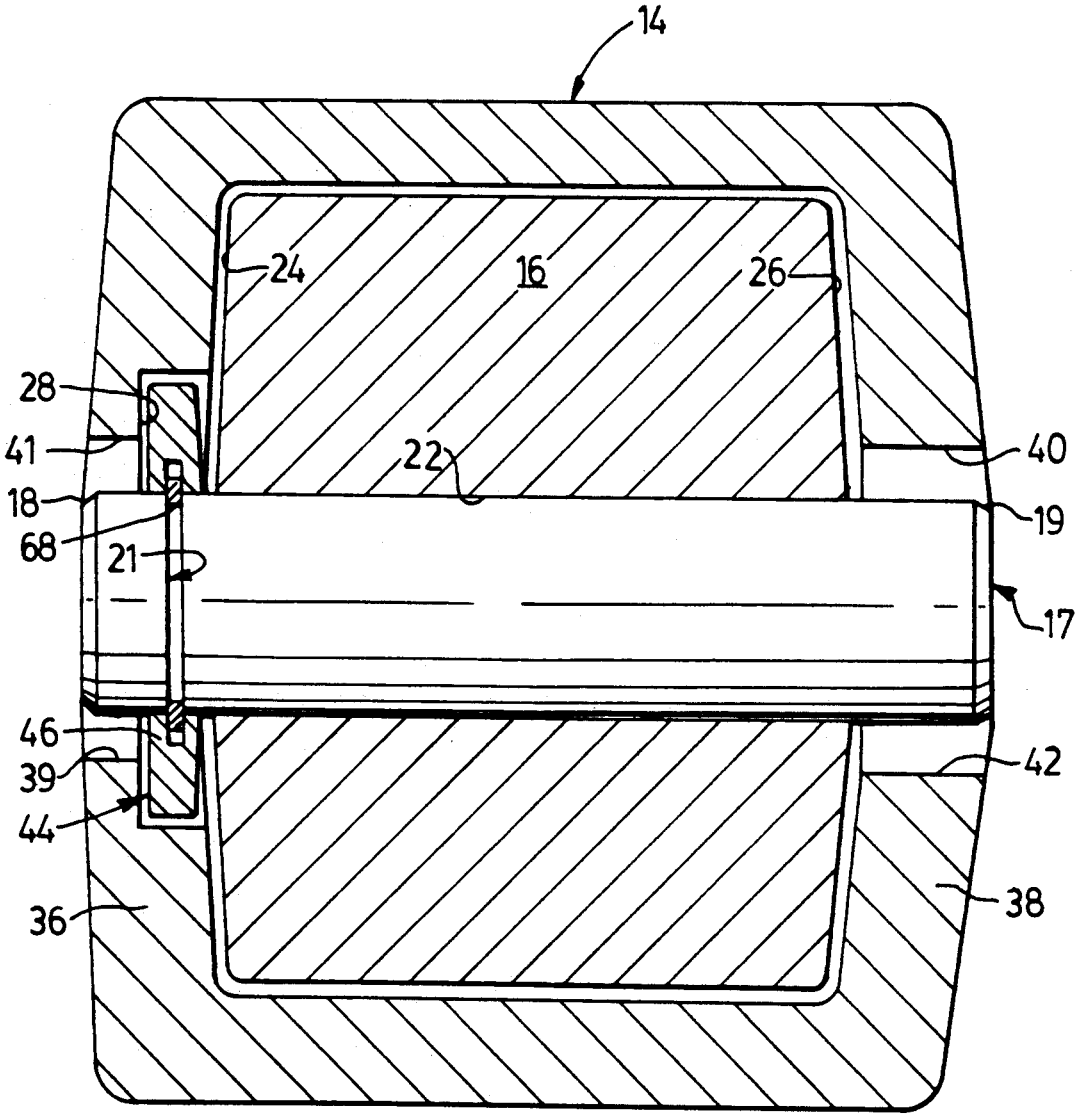
FIG. 7 is an enlarged cross-sectional view of the assembled earthworking device with a recess formed in a lateral sidewall of the earthworking tip.

As best shown in FIGS. 2 and 3, a keeper means 44 is mounted in the recess 28 formed in the lateral wall 24 of the nose 16 for securing the pin 17 in the bore 22 of nose 16. It is recognized that the recess 28 could equally be formed in lateral sidewall 26 of the nose 16 or in either of the sidewalls 36 or 38 of the tip without departing from the subject invention and reference is made to FIG. 7.

The keeper means includes a washer 46 having an inside surface 47 defining a bore 48 with a radial annular groove 50 defined in the washer and opening into the bore. The washer 46 is preferably made of metallic material or any other suitable material. The washer 46 further has a flat inner side surface 52 adjacent the end wall 29 of the counterbore 28 and a frusto-conical outer side surface 54 adjacent the sidewall 36 of the tip 14. It should be recognized that a similar outer frusto-conical surface could be on the opposite side of the washer 46 without departing from the essence of the subject invention.

As best shown in FIG. 4, the groove 50 of the washer 46 has a pair of generally parallel sidewalls 56 and 58 and a bottom surface 60 spaced from the bore 48 defining a predetermined depth A for the groove.

The groove 21 in the pin 17 has a pair of generally parallel sidewalls 62 and 64 and a bottom surface 66 spaced from the outer peripheral surface 20 of the pin 17 defining a predetermined depth B for the groove.

A split resilient retaining ring 68 having a cross-section that is generally rectangular has a pair of generally parallel sidewalls 70 and 72 defining a predetermined width C and a pair of generally parallel inner and outer surfaces 74 and 76 defining a predetermined radial thickness D. The ring 68 is slidably captured in the groove 50 of the washer 46. The ring 68 may be composed of a conventional spring steel or like material which exhibits the desired resiliency, hardness and spring back capabilities required for pin 17 retention purposes.

The pin 17 in the assembled position is slidably disposed within the bore 22 of the nose 16, the bore 48 of the washer 46 and extends substantially through the holes 39 and 40 of the sidewalls 36 and 38 of the tip 14. The ring 68 is disposed in locking engagement with the groove 21 of the pin 17 and the groove 50 in the washer 46.

Preferably, the depth A of groove 50 in the washer 46 is equal to or greater than the predetermined radial thickness D of the ring 68. The predetermined depth B of the groove 21 in the pin 17 is generally equal to one-half of the predetermined radial thickness D of the ring 68.

Figure 5:
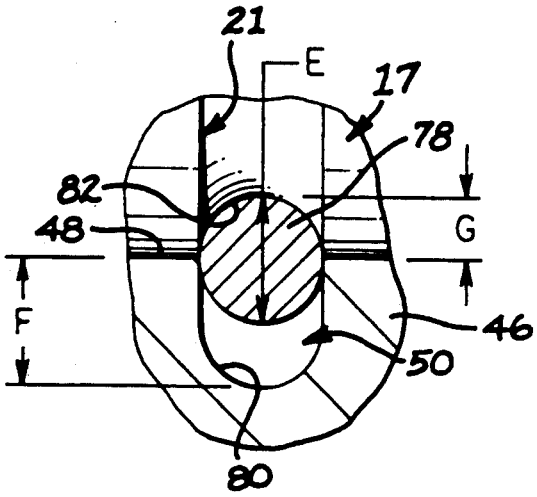
FIG. 5 is an enlarged cross-sectional view of an alternate embodiment of the resilient retaining ring.

Referring now to FIG. 5, an alternate embodiment of the present invention is illustrated and includes a split resilient retaining ring 78 having a cross-section that is generally circular with a predetermined radial thickness E.

The ring 78 is slidably captured in the groove 50 of the washer 46. A bottom surface 80 of the groove 50, spaced from the bore 48, has a profile generally corresponding to the circular cross-section of the ring 78 and defines a depth F for the groove.

The groove 21 in the pin 17 has a root profile 82 generally corresponding to the circular cross-section of the ring 78 and defines a predetermined depth G for the groove.

The ring 78 is disposed in locking engagement with the groove 21 of the pin 17 and the groove 50 in the washer 46.

It is recognized that the bottom surface 80 of groove 50 and the profile 82 of groove 21 in pin 17 need not correspond exactly to the circular cross-section of the ring 78 and may in fact be like that shown in FIG. 4.

Preferably, the depth F of groove 50 in the washer 46 is equal to or greater than the predetermined radial thickness E of ring 78 and the predetermined depth G of the groove 21 in the pin 17 is generally equal to one-half of the predetermined radial thickness E of the ring 78.

Figure 6:
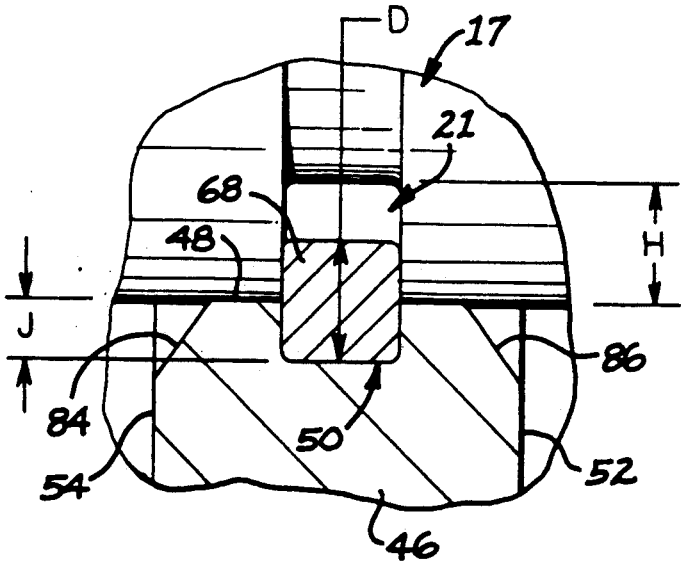
FIG. 6 is an enlarged cross-sectional view of an alternate embodiment of the subject invention.

Referring now to FIG. 6, an alternate embodiment of the present invention is illustrated. The groove 21 in the pin 17 has a depth H preferably equal to or greater than the predetermined radial thickness D of the ring 68. The ring 68 is slidably captured in the groove 21 of the pin 17. The radial annular groove 50 in washer 46 preferably has a depth J generally equal to one-half of the radial thickness D of the ring 68. A pair of beveled surfaces 84 and 86 are provided at the intersection of the bore 48 and the side surfaces 52 and 54 of the washer 46. The beveled surfaces 84 and 86 are dimensioned to provide a camming function to compress ring 68 into groove 21 during assembly.

It is recognized that the split resilient ring 78 having a cross-section that is generally circular could be slidably captured in the groove 21.

INDUSTRIAL APPLICABILITY

The earthworking device 10 of the present invention is particularly adaptable for positive retention of earthworking tips or teeth detachable mounted on support adapters and may be equally useful for the retention of tips used on trenchers or on the cutting edge of a loader bucket. Because the tips and the pins are subjected to extreme bending, twisting and vibration it is extremely difficult to provide positive pin retention while still allowing periodic replacement.

In operation, referring to FIGS. 1, 2, 3, and 4, the keeper means 44 is initially placed in recess 28 and the tip 14 is telescopically mounted on the nose 16 of the adapter 12. This captures keeper means 44 between the end wall 29 of the recess 28 and the sidewall 36 of the tip 24. The flat inner surface 52 of the washer 46 is positioned adjacent the end wall 29 of the recess with the conical outer side surface 54 adjacent the sidewall 36 of the tip. Pin 17 is then driven manually, by a sledge hammer or the like, through the aligned holes 39 and 40 in the tip 14, the bore 22 in the nose 16 of adapter 12 and the bore 48 in the washer 46 of the keeper means 44. Driving of the pin 17 through the bore 48 of the washer 46 expands the split resilient retaining ring 68 outward into the groove 50 of the washer and around the pin 17 until the groove 21 in the pin 17 radially aligns with the groove 50. At this point, the retaining ring 68 "springs inward" engaging the groove 21 of the pin. This positively locks the pin 17 in place and retains the tip 14 on the adapter 12. Depending upon the direction the pin 17 is driven through the bore 48, one of the beveled surfaces 18 or 19 provides a camming function to expand the ring 68 outward into groove 50.

In the design of FIGS. 1, 2, 3 and 4, the ring 68 has a cross-section that is generally rectangular with generally parallel sidewalls 70 and 72 that engage the generally parallel sidewalls 56 and 58 of the groove 50 in the washer 46 and the generally parallel sidewalls 62 and 64 of the groove 21 in the pin 17. As shown in the figures, in the assembled position, approximately one-half of the predetermined thickness D of the ring 68 is located in the groove 21 of the pin 17 and approximately one-half is located in the groove 50 of the washer 56. It is recognized that the groove 21 in the pin 17 need only have a depth B sufficient to prevent camming of the ring 68 out of the groove 21. Desirably, any axial force on the end of the pin 17, during operation of the earthworking device 10, trying to dislodge the pin 17 from the bore 48 of the captured washer 46 is resisted by the ring 68 overlapping the grooves 21 and 50 with the maximum section thickness C of the ring 68 being in shear.

In order to disassemble the pin 17 from the bore 22 of the nose 16 for periodic replacement of the tip 14, a force must be applied on the end of the pin by a sledge hammer or the like sufficient to physically shear the ring 68 at the interface of the grooves 21 and 50 or alternately to cause fracture of the washer 46. It is recognized that the amount of force to shear the ring 46 or the fracture of the washer 46 can be changed or controlled by changing either the cross-section of the ring or washer that is in shear, the type of material and/or the heat treatment of the elements. In one working example, the force necessary to cause the retaining ring 68 to shear is in the range of 143–257 kN (32,200–57,700 lbs.). This being based on having a section thickness C in shear of approximately 3.0 mm (0.118 inches).

When the pin 17 is driven towards the sidewall 36 of the tip 14, the frusto-conical outer side surface 54 of the washer 46 cooperates with the forwardly converging sidewall 36 in such a manner that contact of the surface 54 with wall 36 will be substantially towards the outer peripheral surface 20 of the pin. Thus there is less tendency of the washer 46 to "cock" relative to the pin 17 and concentrate more of the force to shear ring 68 close to the interface of the groove 21 and 50. It is recognized that both side surfaces of the washer 46 could be frusto-conical whereupon the washer could not be installed backwards.

In a manner similar to the preceding design, FIG. 5 discloses a split resilient retaining ring 78 having a generally circular cross-section with approximately one-half of the predetermined radial thickness E of the ring located in the groove 50 of the washer 46 and approximately one-half located in the groove 21 of the pin 17 to prevent camming of the ring 78 out of the grooves 21 and 50. Desirably, during operation, any axial force on the end of the pin 17 trying to dislodge the pin from the bore 48 of washer 46 is resisted by the ring 78 overlapping the grooves 21 and 50 places the maximum radial section thickness E of the ring in shear.

To disassemble pin 17 the ring 78 must be sheared or the washer 46 must be fractured.

In the alternate embodiment of FIG. 6, the ring 68 is slidably captured in the groove 21 of the pin 17. Preferably the depth H of the groove 21 is equal to or greater than the predetermined radial thickness D of the ring 68 and the depth J of the groove 50 in the washer 46 is equal to one-half the radial thickness D of the ring 68. In the assembled position, approximately one-half of the predetermined thickness D of the ring is located in the groove 21 of the pin 17 and approximately one-half is located in the groove 50 of the washer 46. As set forth above, it is recognized that the groove 50 in the washer 46 need only have a depth H sufficient to prevent camming of the ring 68 out of the groove 50.

When pin 17 is driven manually through bore 48 of the washer 46, the split resilient ring 68 is compressed into groove 21 until the groove 50 in the washer 46 radially aligns with the groove 21. At this point, the retaining ring 68 "springs back" engaging the groove 50 of the washer 46. Depending upon the direction, the pin 17 is driven through bore 48, one of the beveled surfaces 84 or 86 provides a camming function to compress the ring 68 into the groove 21.

From the foregoing, it will be apparent the subject invention provides a means for positively retaining the earthworking tip 14 on the adapter 12.

Other aspects, objects, and advantages can be obtained from a study of the drawings, the disclosure and the appended claims.

We claim:

1. A retaining pin and a keeper means for use in an earthworking device, comprising:

the retaining pin having an outer peripheral surface with an annular groove defined in the outer peripheral surface; and the keeper means including a metallic washer and a resilient retaining ring, the metallic washer having a frusto-conical side surface and an and an inside surface defining a bore with an annular groove opening in the bore, the pin being slidably disposed within the bore, and the resilient retaining ring having a cross-section with a predetermined radial thickness and when assembled is disposed in locking engagement within the groove on the pin and the groove in the washer, the depth and configuration of the grooves being sufficient to prevent camming of the resilient ring out of the grooves, the retaining ring, in use, is operative in conjunction with the grooves in the pin and the washer to prohibit disassembly of the pin from the washer without an external force being applied to the pin sufficient to shear the retaining ring or to fracture the washer, and the frusto-conical side surface of the washer is effective to concentrate the force close to the interface of the grooves.

2. The retaining pin and the keeper means of claim 1 wherein said cross-section of the retaining ring is generally rectangular in cross-section.

3. The retaining pin and the keeper means of claim 1 wherein one of the grooves in the pin and washer has a depth equal to or greater than the predetermined radial thickness of the retaining ring.

4. The retaining pin and the keeper means of claim 3 wherein the other one of the grooves has a depth equal to substantially one-half of the predetermined radial thickness of the retaining ring.

5. The retaining pin and the keeper means of claim 4 wherein said retaining ring has a circular cross-section.

6. The retaining pin and the keeper means of claim 1 wherein the depth of the groove in the pin is generally equal to one-half of the predetermined radial thickness of the retaining ring and the groove in the washer has a depth equal to or greater than the predetermined radial thickness of the retaining ring.

7. The retaining pin and the keeper means of claim 1 wherein the resilient retaining ring is split and circular.

8. A retaining pin and a keeper means adapted for use in an earthworking device having a nose and a tip telescopically mounted on the nose, the nose has a transverse bore and a pair of laterally converging sidewalls, and the tip defines a mating socket with a pair of laterally spaced apart converging sidewalls defining a pair of aligned holes therein axially aligned with the transverse bore, and a recess defined in one of the nose and the tip in axial alignment with the transverse bore and the holes, the retaining pin and the keeper means comprising:

the retaining pin having an outer peripheral surface with an annular groove defined in the outer peripheral surface; and the keeper means includes a metallic washer and a resilient retaining ring, the washer has a frusto-conical side surface and an inside surface defining a bore with an annular groove opening in the bore, the keeper means when assembled is disposed in the recess of the nose or the tip, and the pin, in use, is disposed in the aligned bore and extends substantially through the pair of aligned holes in the sidewalls of the tip to retain the tip on the nose, the pin being slidably disposed within the bore of the metallic washer, the ring has a cross-section with a predetermined radial thickness and is disposed in locking engagement within the groove on the pin and the groove in the washer, the depth and configuration of the grooves being sufficient to prevent camming of the ring out of the grooves, the ring, in use, is operative in conjunction with the grooves in the pin and the washer to prohibit disassembly of the pin from the washer without an external force being applied to the pin sufficient to shear the ring or to fracture the washer, and the frusto-conical side surface of the washer is adapted for cooperation with one of the pair of lateral converging sidewalls of the nose or the pair of laterally spaced apart converging sidewalls of the tip to effectively concentrate the external force close to the interface of the grooves.

9. The retaining pin and the keeper means of claim 8 wherein said cross-section of the retaining ring is generally rectangular in cross-section.

10. The retaining pin and the keeper means of claim 8 wherein one of the grooves in the pin and washer has a depth equal to or greater than the predetermined radial thickness of the retaining ring.

11. The retaining pin and the keeper means of claim 10 wherein the other one of the grooves has a depth equal to one-half of the predetermined radial thickness of the retaining ring.

12. The retaining pin and the keeper means of claim 11 wherein said retaining ring has a circular cross-section.

13. The retaining pin and the keeper means of claim 8 wherein the depth of the groove in the pin is generally equal to one-half of the predetermined radial thickness of the retaining ring and the groove in the washer has a depth equal to or greater than the predetermined radial thickness of the retaining ring.

14. The retaining pin and the keeper means of claim 8 wherein the resilient retaining ring is split and circular.

* * * * *